United States Patent [19]

Johnson et al.

[11] 4,404,821

[45] Sep. 20, 1983

[54] YARN FEEDER AND CHANGER UNIT

[75] Inventors: Bertram Johnson, Braunstone; Arthur R. Smith, Leicester, both of England

[73] Assignee: Wildt Mellor Bromley Limited, Leicester, England

[21] Appl. No.: 184,295

[22] Filed: Sep. 5, 1980

[30] Foreign Application Priority Data

Sep. 28, 1979 [GB] United Kingdom ..... 7933686

[51] Int. Cl.[3] ..... D04B 15/60

[52] U.S. Cl. ..... 66/139; 66/140 R

[58] Field of Search ..... 66/133, 134, 138, 139, 66/140 R, 140 S

[56] References Cited

U.S. PATENT DOCUMENTS

| | | | |
|---|---|---|---|
| 694,515 | 3/1902 | Young | 66/138 |
| 1,626,781 | 5/1927 | Bosworth | 66/138 X |
| 1,643,341 | 9/1927 | Landry | 66/138 |
| 3,605,444 | 9/1971 | Lonati | 66/133 X |

FOREIGN PATENT DOCUMENTS

| | | | |
|---|---|---|---|
| 23758 | of 1907 | United Kingdom | 66/138 |
| 340652 | 1/1931 | United Kingdom . | |
| 821151 | 9/1959 | United Kingdom | 66/140 R |
| 1156304 | 6/1969 | United Kingdom | 66/138 |
| 1556659 | 11/1979 | United Kingdom | 66/140 R |
| 515849 | 8/1976 | U.S.S.R. | 66/140 R |

*Primary Examiner*—Wm. Carter Reynolds

*Attorney, Agent, or Firm*—Buell, Blenko, Ziesenheim & Beck

[57] ABSTRACT

A yarn feeder and changer unit for a knitting machine comprises a number of adjacent yarn feeders any one of which can be moved from a yarn trapping position to a yarn feeding position while the others retain severed ends of their respective yarns at the trapping positions. The movement of each feeder to its feeding position comprises an upward component of movement from below the needle level by pivotal movement about a horizontal axis, and forward movement over the needles by a sliding component of movement. The creation of two distinct components of movement for each feeder (pivotal and sliding) enables the feeder path to pass close to but out of the path of the needles, and enables accurate yarn placement to be achieved.

12 Claims, 7 Drawing Figures

YARN FEEDER AND CHANGER UNIT

DESCRIPTION

This invention relates to yarn feeder and changer units, otherwise known as striper units, for knitting machines. In such units any of a number of adjacent yarn feeders can be moved from a stowed position adjacent a yarn cutter and trapper mechanism to a yarn feeding position. In the stowed position when the yarn is cut and the severed end trapped at a level below that of the knitting needles, the greatest degree of yarn control is achieved by having the yarn feeder at that same low level, with the minimum length of yarn between the feeder and trapper. Direct movement of the yarn feeder in a straight line from its trapping position to its yarn feeding position would take the feeder into the path of the needles, which would cause damage.

Prior proposals have therefore provided complex and cumbersome striper mechanisms to place the yarn in the correct feeding position. One prior proposal is that of British Patent Specification No. 821,151 which utilizes feeders pivotable about a first axis, each feeder having an associated yarn placer pivotable about a second axis above and in front of the first axis. Feeder movement is purely pivotal and raises the yarn guide eye of the feeder from the trapping position to above the needle level. Movement of the yarn placement point forwardly over the needles is achieved by pivotal movement of the placer. This prior proposal utilizes two independently movable and independently spring-loaded elements for each yarn to be fed, namely a feeder and a placer.

The need for a separate yarn placer was avoided in British Pat. No. 1,556,659 by lifting each yarn feeder from a suspension point above the needle level and effecting forward movement of a yarn guide eye of the feeder at an appropriate stage during the lifting by means of a fixed pin engaging a Z-shaped cam track in the feeder. This solution is effective, but imparts design limitations. There is always an upward component of feeder movement, as the movement is generated by lifting the feeder at its suspension point. Much of the structure is necessarily above and immediately in front of the needles so that inspection and access is difficult when the unit is installed on the knitting machine. Finally, separate striper cam plates are required for actuating the feeders and the associated yarn cutting and trapping mechanisms, which is an undesirable expense.

This invention provides a yarn feeder and changer unit for a knitting machine comprising a number of yarn feeders each movable between yarn feeding and yarn trapping positions, wherein movement of each feeder from its yarn trapping position to its yarn feeding position is a combination of forward sliding movement and pivotal movement about an axis perpendicular to the direction or plane of sliding, in response to forward sliding movement of an associated actuator slide.

It is an object of the invention to achieve such feeder movement with the feeders mounted in side-by-side relationship on a pair of fixed mounting pins, to achieve maximum precision of feeder movement which is in two separate and defined successive movements from the yarn trapping feeder position to the yarn feeding feeder position.

By combining pivotal and forward sliding movement of the yarn feeders a substantial flexibility of design can be achieved, with the feeder movement upwards from below the needle level being essentially a consequence of the pivotal component of movement and the feeder movement forwards over the needles being essentially a consequence of the sliding component of feeder movement.

Although a simple and therefore often preferred sequence of feeder movement involves these two components of feeder movement as two separate and successive movements of the yarn guide eyes of the feeders, it is possible according to the invention to combine the two components of movement as desired to cause the yarn guide eye to traverse a wide variety of paths from its yarn trapping position to its yarn feeding position.

One of the components of feeder movement is preferably cam actuated. For example the pivotal movement may be in response to cam action of the actuator slide on the feeder, while the sliding movement of the feeder is movement of the actuator slide and feeder together and in the same direction. Each feeder is slidably and pivotally mounted on first and second spaced fixed pins, and each feeder may have a camway cooperating with an associated lever plate that is pivotally mounted on the first pin. In such a construction the feeder movement may comprise actuating movement of each lever plate in response to forward movement of its associated actuator slide causing its feeder to move from its yarn trapping position to its yarn feeding position by a combination of pivotal movement, together with the lever plate, about the first pin and forward sliding movement, relative to the lever plate, over the first and second pins under the cam action of the lever plate.

The invention is illustrated by the drawings, of which:

FIG. 2 includes additional detail necessary for a complete understanding of the unit but this detail has not been repeated in FIGS. 1, 3 and 4;

FIG. 7 is a plan view of a striper cam plate of a knitting machine for use with the unit of FIGS. 1 to 6.

Figure 1:
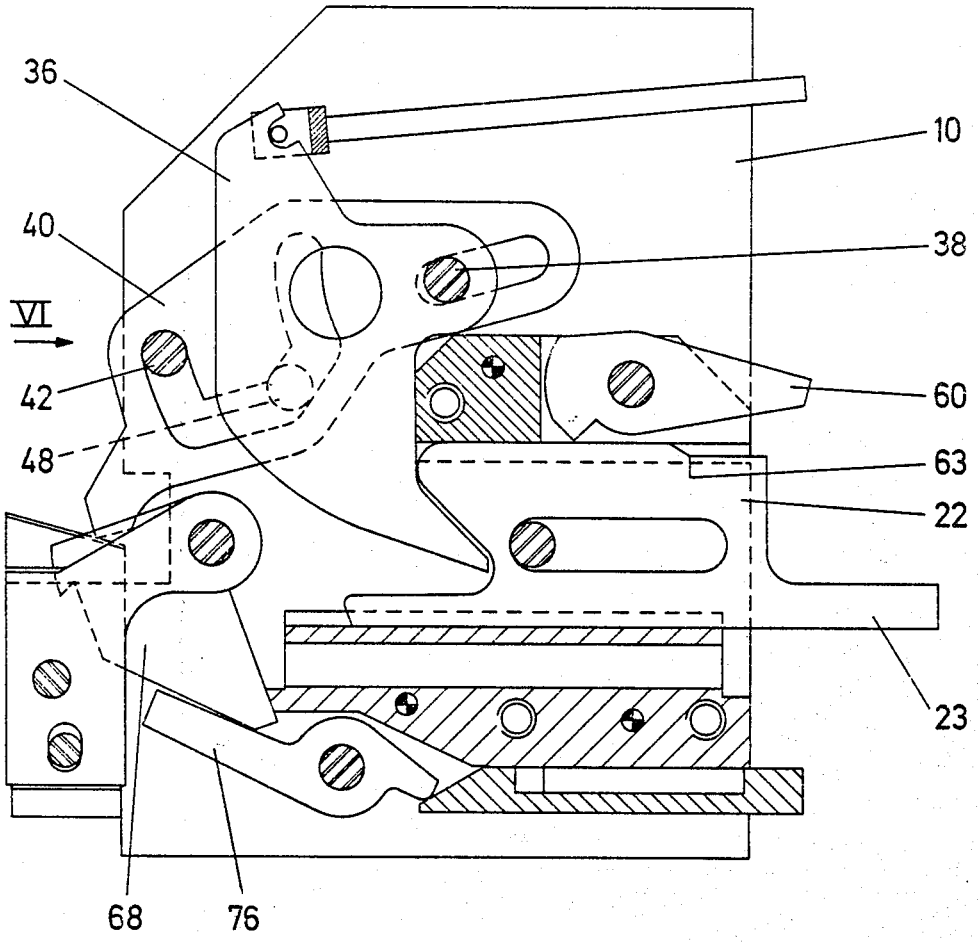
FIGS. 1 to 4 are vertical sections through a yarn feeder and changer unit according to the invention at four consecutive stages of advancement of a yarn feeder from a trapping position (FIG. 1) to a yarn feeding position (FIG. 4).
Figure 2:
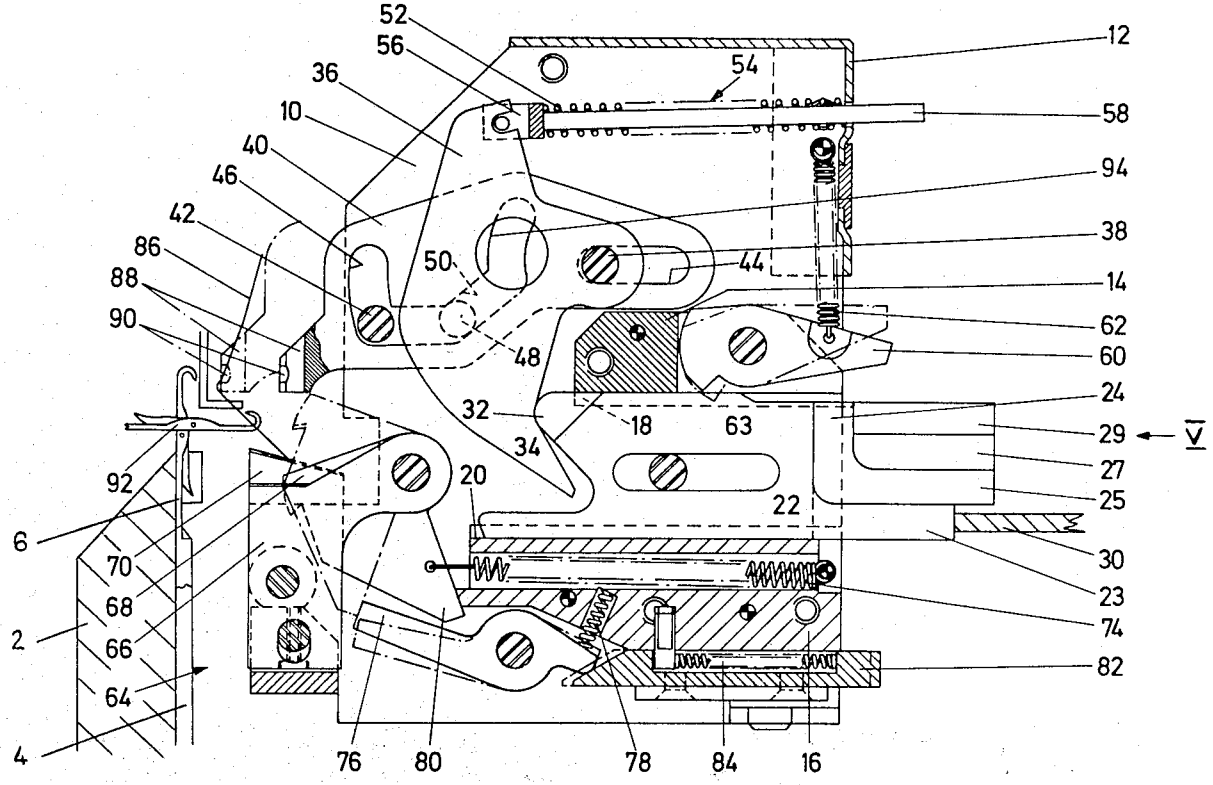
Figure 3:
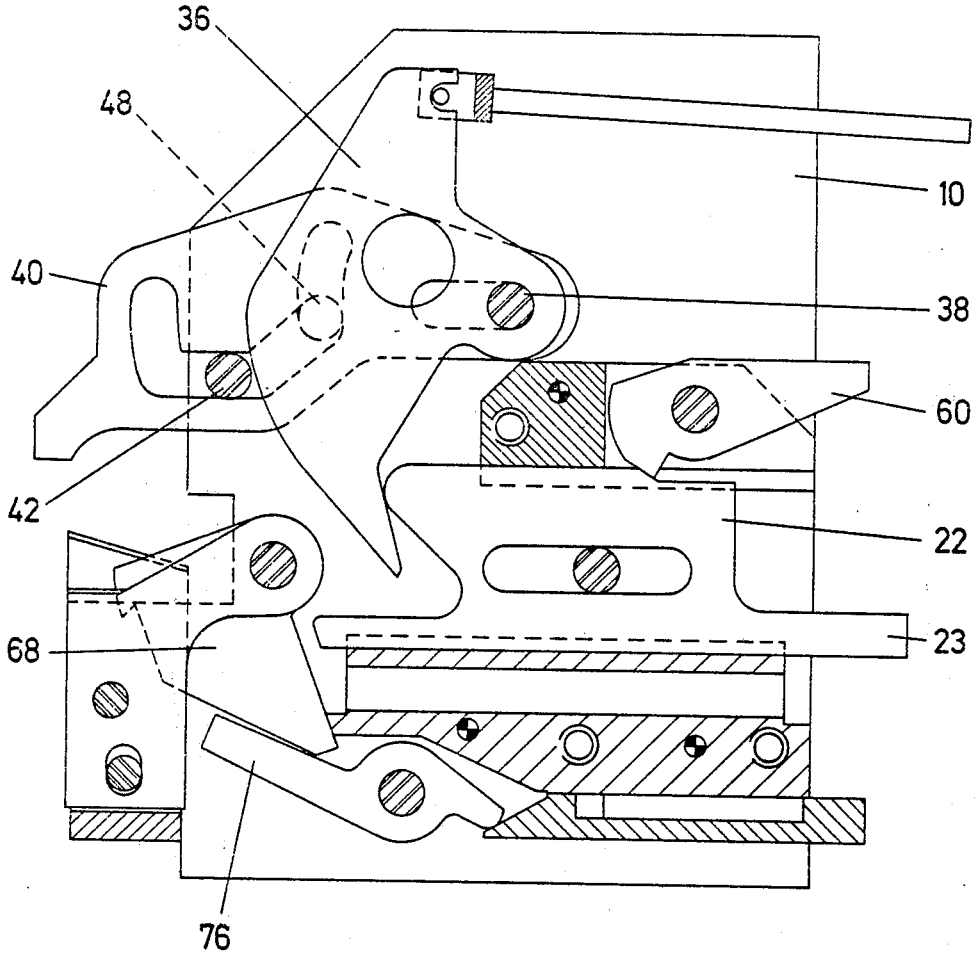
Figure 4:
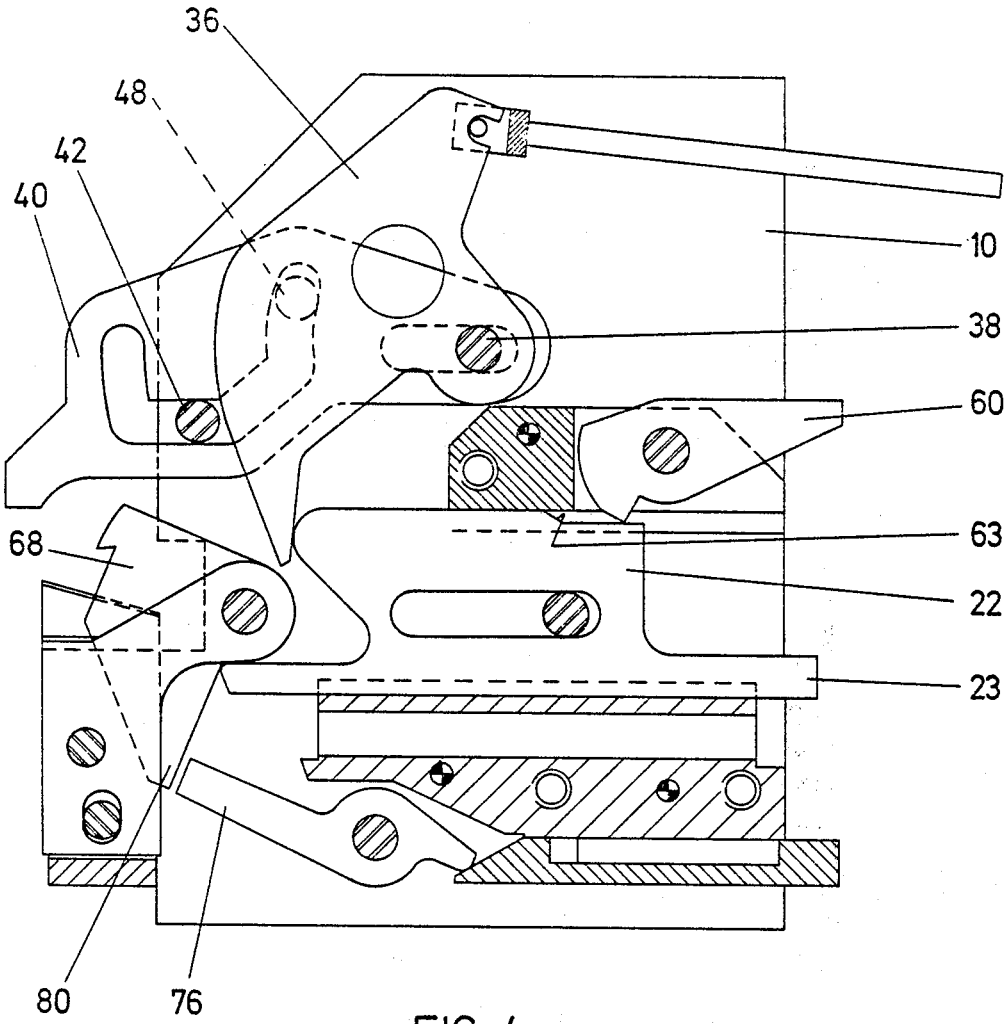
Figure 5:
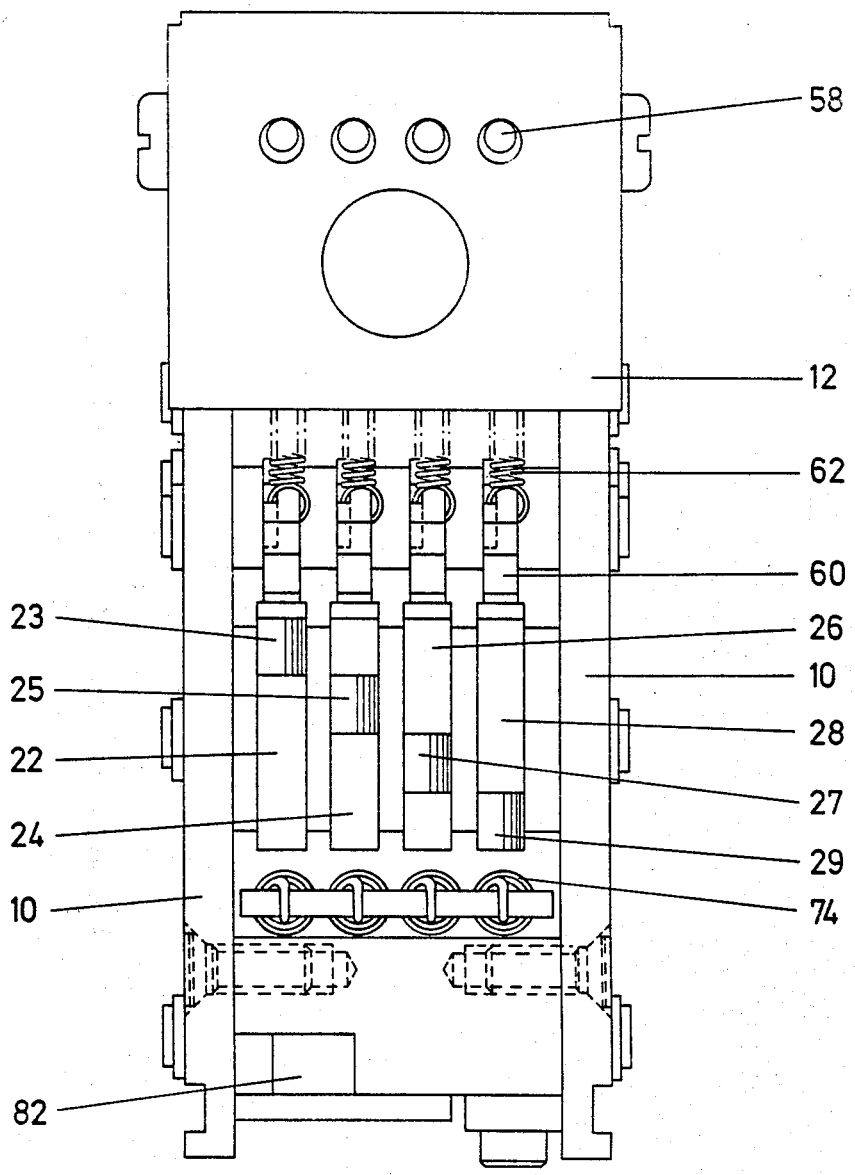
FIG. 5 is an end elevation of the unit of FIGS. 1 to 4 in the direction of the arrow V (FIG. 2)
Figure 6:
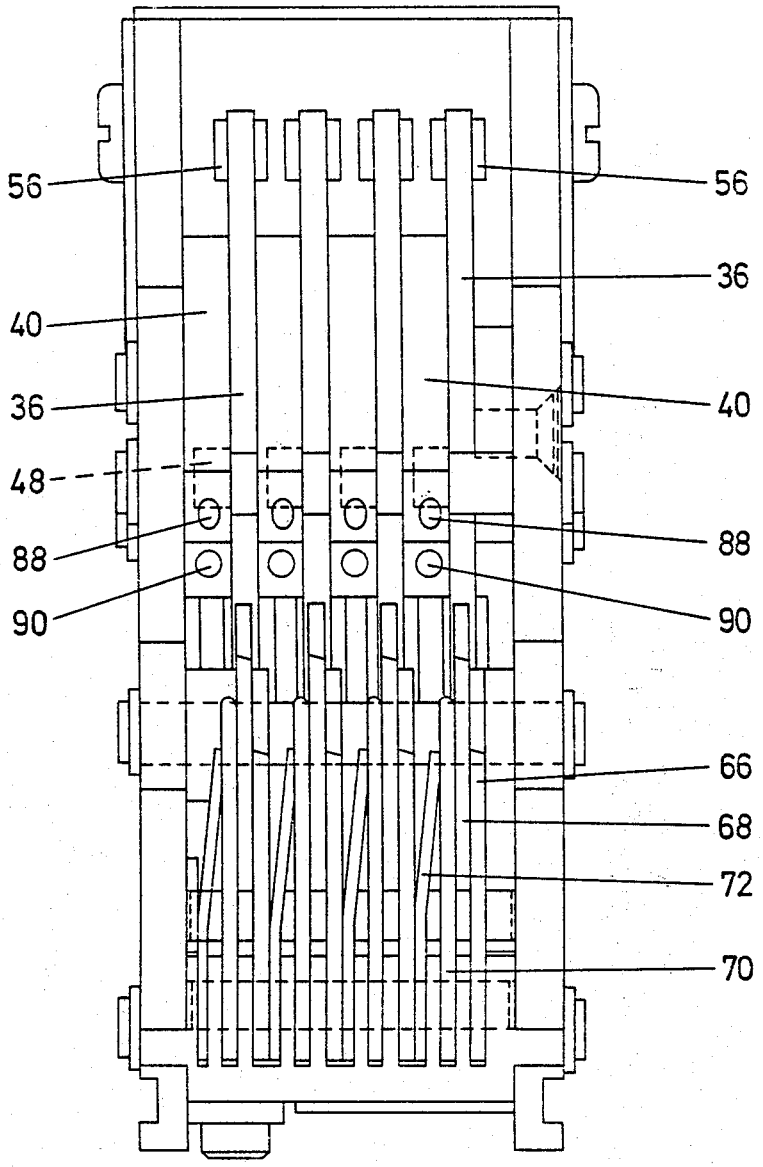
FIG. 6 is an end elevation of the unit of FIGS. 1 to 4 in the direction of the arrow VI (FIG. 1)

FIG. 2 depicts a part of a needle cylinder 2 of a knitting machine, in which needle cylinder are formed tricks 4 in which cylinder needles 6 are reciprocably movable. Other needles 92 are dial needles movable in a dial (not shown) of the knitting machine.

The yarn feeder and changer unit of FIGS. 1 to 6 comprises a housing or fixed support frame, formed by side plates 10 spaced apart by a cover 12 and by mounting blocks 14 and 16 in which are formed slideways 18 and 20 for an array of four actuator slides 22, 24, 26 and 28. The actuator slides 22, 24, 26 and 28 have actuating butts 23, 25, 27 and 29 respectively at different operating heights to that movement of the unit past a stationary striper cam plate 30 in the direction of the arrow C as illustrated in FIG. 7 actuates a selected one of the actuator slides, the selection depending on the height of the plate 30.

A forwardly facing nose 32 of each actuator slide engages a depending tail 34 of an associated lever plate 36 which is pivotally mounted on a pin 38. A yarn feeder 40 is positioned alongside each lever plate 36 and is slidably and pivotally mounted on the pin 38 and a pin pivotal movement and forward or rearward sliding movement. If the rearwardly extending portion of the L-shaped slot 46 were parallel to the slot 44 but both slots were inclined upwardly or downwardly, the forward movement of the feeder 40 would be along a similarly inclined path. If the rearwardly extending portion of the L-shaped slot 46 were other than parallel to the slot 44, the forward movement of the feeder 40 would have a pivotal component of movement which could result in upward or downward movement of the yarn guide eye 88, 90. Thus the designer is given sufficient freedom to ensure that the feeder movement is from the optimum yarn trapping position to the optimum yarn feeding position along the optimum path, for any design of knitting machine.

We claim:

1. In a knitting machine having a circular array of needles axially reciprocable in tricks in at least one needle cylinder, a yarn feeder and changer unit comprising:

a fixed support frame alongside the needle cylinder or cylinders;

first and second parallel mounting pins rigidly mounted on said support frame;

a number of yarn feeders mounted on the said mounting pins in side-by-side relationship, each having a yarn guide eye and each being movable on the said mounting pins between a first position in which the said yarn guide eye is in a yarn trapping position and a second position in which the said yarn guide eye is in a yarn feeding position, said first mounting pin passing through a first elongate slot in each yarn feeder and said second mounting pin passing through a second elongate slot in each yarn feeder; and actuating means including a linearly reciprocable slide member for each yarn feeder, whereby linear movement of each slide member in an actuating direction causes the associated yarn feeder to move from its first position to its second position in two separate and defined successive movements of which the first is a pivotal movement of the yarn feeder about the said first mounting pin and the second is a sliding movement of the yarn feeder over the said first and second mounting pins, said actuating means for each yarn feeder comprises said slide member and a lever plate, the lever plate being pivotally mounted on said first mounting pin and having cam means engaging the associated yarn feeder, and the slide member bearing on the lever plate so that linear movement of each slide member in the said actuating direction causes a pivotal movement of the associated lever plate and yarn feeder together about said first mounting pin to complete the said first feeder movement, followed by a continued pivotal movement of said lever plate about said first mounting pin to cam the yarn feeder in a sliding movement over said first and second mounting pins to complete the said second feeder movement.

2. A yarn feeder and changer unit according to claim 1, wherein the second slot of each yarn feeder comprises a first branch that is generally arcuate about a forward end of the first slot, and a second branch that extends rearwardly of the first branch.

3. A yarn feeder and changer unit according to claim 2, wherein the second branch of the second slot of each yarn feeder is generally parallel to the first slot.

4. A yarn feeder and changer unit according to claim 1, wherein said cam means on each lever plate comprises a stub shaft on the lever plate engaging a cam slot in the associated feeder for two-way cam movement of the feeder by the lever plate.

5. A yarn feeder and changer unit according to claim 4, wherein the cam slot in each feeder is a continuation of the second slot.

6. A yarn feeder and changer unit according to claim 5, wherein the cam slot in each feeder terminates in an arcuate portion centred around a rearward end of the first slot, so that further pivotal movement of the lever plate is permitted when the feeder is in its yarn feeding position, without corresponding movement of the feeder.

7. A yarn feeder and changer unit according to claim 4, wherein each lever plate has a tail depending into the path of its associated slide member so that forward movement of the slide member effects the pivotal actuating movement of the lever plate.

8. A yarn feeder and changer unit according to claim 7 wherein each lever plate is spring-biased in a direction opposing its pivotal actuating movement.

9. A yarn feeder and changer unit according to claim 7 or claim 8, wherein the slide members have operating butts at different heights for actuation by striper plates of the knitting machine.

10. A yarn feeder and changer unit according to claim 1, further comprising a latch mechanism associated with each slide member for releasably retaining the slide member in a forward actuating position.

11. A yarn feeder and changer unit according to claim 1, wherein forward movement of each slide member beyond a position necessary to bring its associated feeder into its yarn feeding position effects yarn release movement of a yarn cutter and trapper mechanism for that feeder.

12. A yarn feeder and changer unit according to claim 11, further comprising a latch mechanism for releasably retaining the yarn cutter and trapper mechanisms in their yarn releasing positions against the bias of spring means.

* * * * *

United States Patent [19]

Green

[11] 4,404,822

[45] Sep. 20, 1983

[54] PRE-COILED CABLE-LOCK DEVICE

[76] Inventor: Leonard O. Green, 922 S. Birch St., Santa Ana, Calif. 92701

[21] Appl. No.: 265,041

[22] Filed: May 18, 1981

[51] Int. Cl.[3] ..... B62H 5/00; E05B 71/00; E05B 73/00

[52] U.S. Cl. ..... 70/233; 70/18; 70/49; 224/31; 242/84.8

[58] Field of Search ..... 70/234, 233, 225–227, 70/18, 15, 49, 58, 63, 232, 52, 53; 248/551–553; 280/289 L–289 A; 224/32 R, 31, 30 R; 242/84.8; 24/223

[56] References Cited

U.S. PATENT DOCUMENTS

| | | | |
|---|---|---|---|
| 2,180,117 | 11/1939 | Lipsis | 70/234 X |
| 2,574,967 | 11/1951 | Gossner | 70/49 |
| 3,335,585 | 8/1967 | Stratton | 70/58 |
| 3,756,008 | 9/1973 | Smith | 70/18 X |
| 3,772,645 | 11/1973 | Odenz et al. | 70/234 X |
| 3,905,214 | 9/1975 | Bell | 70/18 X |
| 4,012,930 | 3/1977 | Benson | 70/234 |
| 4,057,983 | 11/1977 | Morgan | 70/18 |
| 4,070,879 | 1/1978 | Thompson | 70/49 X |
| 4,186,576 | 2/1980 | Means et al. | 70/233 |
| 4,188,808 | 2/1980 | Valdez | 70/233 |

FOREIGN PATENT DOCUMENTS

| | | | |
|---|---|---|---|
| 132445 | 7/1902 | Fed. Rep. of Germany | 70/233 |
| 205278 | 12/1908 | Fed. Rep. of Germany | 70/226 |
| 2807650 | 8/1979 | Fed. Rep. of Germany | 70/49 |
| 238520 | 5/1946 | Switzerland | 70/233 |
| 9747 | of 1897 | United Kingdom | 70/227 |
| 124227 | 3/1919 | United Kingdom | 70/227 |

*Primary Examiner*—Richard E. Moore
*Assistant Examiner*—Carl F. Pietruszka
*Attorney, Agent, or Firm*—Francis X. LoJacono

[57] ABSTRACT

A pre-coiled cable-lock device for use with a motorcycle and other like vehicles, wherein the device comprises a housing having a drum-like compartment in which an elongated precoiled cable is stored. The housing includes a securing member for attaching the housing to a suitable frame member of the motorcycle. One end of the cable is fixedly secured within the compartment, and the opposite free end is provided with a keeper member arranged to be received in and form part of the housing wall when in a stored mode, the keeper being held therein by a locking front plate. When in a cable-locking mode, the cable is looped in a suitable manner to a fixed structure or through one wheel, the keeper member being reinserted into the housing wall and again held in place by the locking plate, thereby preventing the removal of the keeper member.

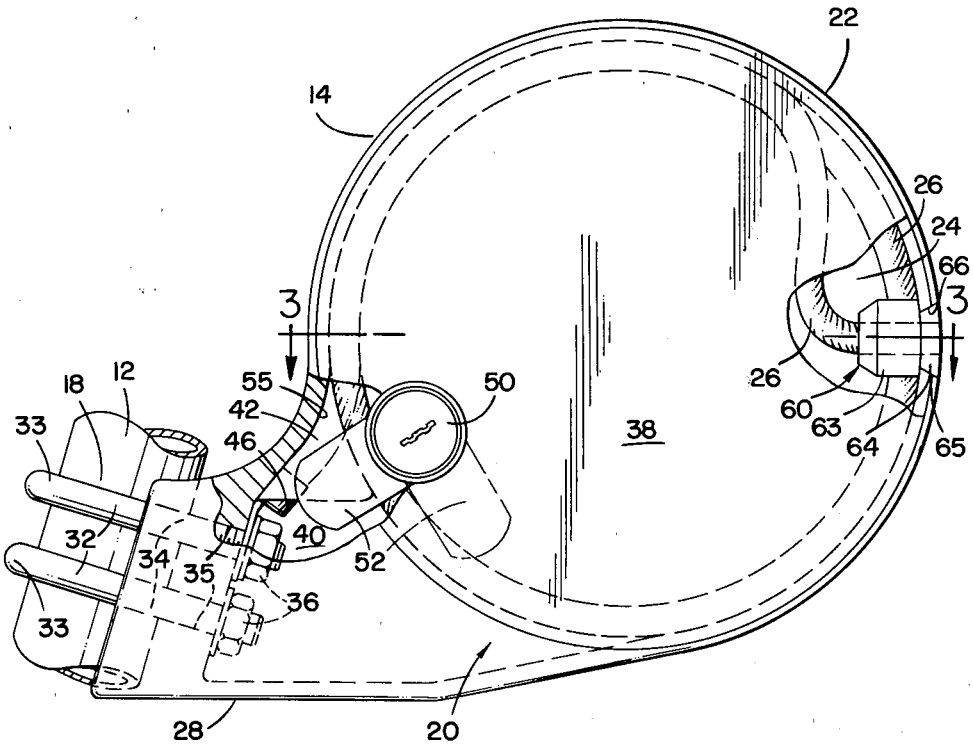

7 Claims, 7 Drawing Figures